US007573448B2

(12) United States Patent
Credelle et al.

(10) Patent No.: US 7,573,448 B2
(45) Date of Patent: Aug. 11, 2009

(54) DOT INVERSION ON NOVEL DISPLAY PANEL LAYOUTS WITH EXTRA DRIVERS

(75) Inventors: Thomas Lloyd Credelle, Morgan Hill, CA (US); Matthew Osborne Schlegel, Palo Alto, CA (US)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/681,697

(22) Filed: Mar. 2, 2007

(65) Prior Publication Data

US 2007/0146270 A1 Jun. 28, 2007

Related U.S. Application Data

(63) Continuation of application No. 10/456,806, filed on Jun. 6, 2003, now Pat. No. 7,187,353.

(51) Int. Cl.
*G09G 3/36* (2006.01)

(52) U.S. Cl. ..... 345/88

(58) Field of Classification Search ..... 345/87–104, 345/204, 208–210, 694–696
See application file for complete search history.

(56) References Cited

U.S. PATENT DOCUMENTS

| | | | |
|---|---|---|---|
| 3,971,065 | A | 7/1976 | Bayer |
| 4,353,062 | A | 10/1982 | Lorteije et al. |
| 4,642,619 | A | 2/1987 | Togashi |
| 4,651,148 | A | 3/1987 | Takeda et al. |
| 4,773,737 | A | 9/1988 | Yokono et al. |
| 4,800,375 | A | 1/1989 | Silverstein et al. |
| 4,822,142 | A | 4/1989 | Yasui |
| 4,853,592 | A | 8/1989 | Stratham |
| 4,874,986 | A | 10/1989 | Menn et al. |
| 4,886,343 | A | 12/1989 | Johnson |
| 4,908,609 | A | 3/1990 | Stroomer |
| 4,920,409 | A | 4/1990 | Yamagishi |
| 4,965,565 | A | 10/1990 | Noguchi |
| 5,006,840 | A | 4/1991 | Hamada et al. |
| 5,052,785 | A | 10/1991 | Takimoto et al. |
| 5,097,297 | A | 3/1992 | Nakazawa |

(Continued)

FOREIGN PATENT DOCUMENTS

| | | |
|---|---|---|
| DE | 197 46 329 A1 | 3/1999 |

(Continued)

OTHER PUBLICATIONS

Brown Elliott, C., "Color Subpixel Rendering Projectors and Flat Panel Displays," SMPTE, Feb. 27-Mar. 1, 2003, Seattle, WA pp. 1-4.

(Continued)

*Primary Examiner*—Sumati Lefkowitz
*Assistant Examiner*—Rodney Amadiz
(74) *Attorney, Agent, or Firm*—Haynes and Boone, LLP

(57) ABSTRACT

Dot inversion schemes are disclosed on novel display panel layouts with extra drivers. A display panel comprises substantially a plurality of a subpixel repeating group comprising an even number of subpixels in a gate direction, wherein at least one set of adjacent column of same colored subpixels share image data from a single driver upon the display panel.

5 Claims, 8 Drawing Sheets

U.S. PATENT DOCUMENTS

| | | | | |
|---|---|---|---|---|
| 5,144,288 | A | 9/1992 | Hamada et al. | |
| 5,184,114 | A | 2/1993 | Brown | |
| 5,191,451 | A | 3/1993 | Katayama et al. | |
| 5,311,205 | A | 5/1994 | Hamada et al. | |
| 5,311,337 | A | 5/1994 | McCartney, Jr. | |
| 5,315,418 | A | 5/1994 | Sprague et al. | |
| 5,334,996 | A | 8/1994 | Tanigaki et al. | |
| 5,341,153 | A | 8/1994 | Benzschawel et al. | |
| 5,384,266 | A | 1/1995 | Chapman | |
| 5,398,066 | A | 3/1995 | Martinez-Uriegas et al. | |
| 5,436,747 | A | 7/1995 | Suzuki | |
| 5,459,595 | A | 10/1995 | Ishiguro | |
| 5,461,503 | A | 10/1995 | Deffontaines et al. | |
| 5,485,293 | A | 1/1996 | Robinder | |
| 5,535,028 | A | 7/1996 | Bae et al. | |
| 5,563,621 | A | 10/1996 | Silsby | |
| 5,579,027 | A | 11/1996 | Sakurai et al. | |
| 5,646,702 | A | 7/1997 | Akinwande et al. | |
| 5,648,793 | A | 7/1997 | Chen | |
| 5,739,802 | A | 4/1998 | Mosier | |
| 5,754,163 | A | 5/1998 | Kwon | |
| 5,754,226 | A | 5/1998 | Yamada et al. | |
| 5,767,829 | A | 6/1998 | Verhulst | |
| 5,808,594 | A | 9/1998 | Tsubyama et al. | |
| 5,818,405 | A | 10/1998 | Eglit et al. | |
| 5,818,968 | A | 10/1998 | Yoshimoto | |
| 5,899,550 | A | 5/1999 | Masaki | |
| 5,949,396 | A | 9/1999 | Lee | |
| 5,971,546 | A | 10/1999 | Park | |
| 6,005,692 | A | 12/1999 | Stahl | |
| 6,008,868 | A | 12/1999 | Silverbrook | |
| 6,037,719 | A | 3/2000 | Yap et al. | |
| 6,064,363 | A | 5/2000 | Kwon | |
| 6,069,670 | A | 5/2000 | Borer | |
| 6,088,050 | A | 7/2000 | Ng | |
| 6,097,367 | A | 8/2000 | Kuriwaki et al. | |
| 6,108,122 | A | 8/2000 | Ulrich et al. | |
| 6,115,092 | A | 9/2000 | Greene et al. | |
| 6,144,352 | A | 11/2000 | Matsuda et al. | |
| 6,147,664 | A | 11/2000 | Hansen | |
| 6,151,001 | A | 11/2000 | Anderson et al. | |
| 6,160,535 | A | 12/2000 | Park | |
| 6,188,385 | B1 | 2/2001 | Hill et al. | |
| 6,219,019 | B1 | 4/2001 | Hasegawa | |
| 6,219,025 | B1 | 4/2001 | Hill et al. | |
| 6,225,967 | B1 | 5/2001 | Hebiguchi | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,243,055 | B1 | 6/2001 | Fergason | |
| 6,243,070 | B1 | 6/2001 | Hill et al. | |
| 6,278,434 | B1 | 8/2001 | Hill et al. | |
| 6,326,981 | B1 | 12/2001 | Mori et al. | |
| 6,327,008 | B1 | 12/2001 | Fujiyoshi | |
| 6,332,030 | B1 | 12/2001 | Manjunath et al. | |
| 6,335,719 | B1 | 1/2002 | An et al. | |
| 6,342,876 | B1 | 1/2002 | Kim | |
| 6,348,929 | B1 | 2/2002 | Acharya et al. | |
| 6,377,262 | B1 | 4/2002 | Hitchcock et al. | |
| 6,388,644 | B1 | 5/2002 | De Zwart et al. | |
| 6,392,717 | B1 | 5/2002 | Kunzman | |
| 6,393,145 | B2 | 5/2002 | Betrisey et al. | |
| 6,396,505 | B1 | 5/2002 | Lui et al. | |
| 6,469,766 | B2 | 10/2002 | Waterman et al. | |
| 6,545,653 | B1 | 4/2003 | Takahara et al. | |
| 6,552,706 | B1 | 4/2003 | Ikeda et al. | |
| 6,552,707 | B1 * | 4/2003 | Fujiyoshi | 345/98 |
| 6,570,584 | B1 | 5/2003 | Cok et al. | |
| 6,590,555 | B2 | 7/2003 | Su et al. | |
| 6,624,828 | B1 | 9/2003 | Dresevic et al. | |
| 6,661,429 | B1 | 12/2003 | Phan | |
| 6,674,436 | B1 | 1/2004 | Dresevic et al. | |
| 6,680,761 | B1 | 1/2004 | Greene et al. | |
| 6,714,206 | B1 | 3/2004 | Martin et al. | |
| 6,714,212 | B1 | 3/2004 | Tsuboyama et al. | |
| 6,714,243 | B1 | 3/2004 | Mathur et al. | |
| 6,727,878 | B2 | 4/2004 | Okuzono et al. | |
| 6,738,204 | B1 | 5/2004 | Chuang et al. | |
| 6,750,875 | B1 | 6/2004 | Keely, Jr. et al. | |
| 6,771,028 | B1 | 8/2004 | Winters | |
| 6,784,866 | B2 * | 8/2004 | Udo et al. | 345/100 |
| 6,804,407 | B2 | 10/2004 | Weldy | |
| 6,833,890 | B2 | 12/2004 | Hong et al. | |
| 6,836,300 | B2 | 12/2004 | Choo et al. | |
| 6,850,294 | B2 | 2/2005 | Roh et al. | |
| 6,867,549 | B2 | 3/2005 | Cok et al. | |
| 6,885,380 | B1 | 4/2005 | Primerano et al. | |
| 6,888,604 | B2 | 5/2005 | Rho et al. | |
| 6,897,876 | B2 | 5/2005 | Murdoch et al. | |
| 6,903,378 | B2 | 6/2005 | Cok | |
| 6,903,754 | B2 | 6/2005 | Brown Elliott | |
| 7,110,012 | B2 | 9/2006 | Messing et al. | |
| 7,151,518 | B2 | 12/2006 | Fukumoto | |
| 7,187,353 | B2 * | 3/2007 | Credelle et al. | 345/88 |
| 7,209,105 | B2 | 4/2007 | Elliott | |
| 7,218,301 | B2 * | 5/2007 | Credelle | 345/96 |
| 7,230,667 | B2 | 6/2007 | Shin et al. | |
| 7,268,764 | B2 * | 9/2007 | Song et al. | 345/100 |
| 7,283,142 | B2 * | 10/2007 | Credelle et al. | 345/694 |
| 2001/0015716 | A1 | 8/2001 | Kim | |
| 2001/0048764 | A1 | 12/2001 | Betrisey et al. | |
| 2001/0052897 | A1 | 12/2001 | Nakano et al. | |
| 2002/0015110 | A1 | 2/2002 | Brown Elliott | |
| 2002/0093476 | A1 | 7/2002 | Hill et al. | |
| 2002/0158997 | A1 | 10/2002 | Fukami et al. | |
| 2003/0006978 | A1 | 1/2003 | Fujiyoshi | |
| 2003/0011603 | A1 | 1/2003 | Koyama et al. | |
| 2003/0071943 | A1 | 4/2003 | Choo et al. | |
| 2003/0077000 | A1 | 4/2003 | Blinn et al. | |
| 2003/0090581 | A1 | 5/2003 | Credelle et al. | |
| 2003/0146893 | A1 | 8/2003 | Sawabe | |
| 2003/0189537 | A1 | 10/2003 | Yun | |
| 2003/0218618 | A1 | 11/2003 | Phan | |
| 2004/0008208 | A1 | 1/2004 | Dresevic et al. | |
| 2004/0021804 | A1 | 2/2004 | Hong et al. | |
| 2004/0061710 | A1 | 4/2004 | Messing et al. | |
| 2004/0085495 | A1 | 5/2004 | Roh et al. | |
| 2004/0094766 | A1 | 5/2004 | Lee et al. | |
| 2004/0095521 | A1 | 5/2004 | Song et al. | |
| 2004/0104873 | A1 | 6/2004 | Kang et al. | |
| 2004/0108818 | A1 | 6/2004 | Cok et al. | |
| 2004/0114046 | A1 | 6/2004 | Lee et al. | |
| 2004/0150651 | A1 | 8/2004 | Phan | |
| 2004/0155895 | A1 | 8/2004 | Lai | |
| 2004/0169807 | A1 | 9/2004 | Rho et al. | |
| 2004/0174389 | A1 | 9/2004 | Ben-David et al. | |
| 2004/0179160 | A1 | 9/2004 | Rhee et al. | |
| 2004/0189662 | A1 | 9/2004 | Frisken et al. | |
| 2004/0189664 | A1 | 9/2004 | Frisken et al. | |
| 2004/0213449 | A1 | 10/2004 | Safaee-Rad et al. | |
| 2004/0223005 | A1 | 11/2004 | Lee | |
| 2004/0239813 | A1 | 12/2004 | Klompenhouwer | |
| 2004/0239837 | A1 | 12/2004 | Hong et al. | |
| 2004/0246213 | A1 | 12/2004 | Credelle et al. | |
| 2004/0246278 | A1 | 12/2004 | Elliott | |
| 2004/0246279 | A1 | 12/2004 | Credelle et al. | |
| 2004/0246280 | A1 | 12/2004 | Credelle et al. | |
| 2004/0246381 | A1 | 12/2004 | Credelle | |
| 2004/0246404 | A1 | 12/2004 | Elliott et al. | |
| 2004/0247070 | A1 | 12/2004 | Ali et al. | |
| 2004/0263528 | A1 | 12/2004 | Murdoch et al. | |
| 2005/0007539 | A1 | 1/2005 | Taguchi et al. | |
| 2005/0024380 | A1 | 2/2005 | Lin et al. | |
| 2005/0040760 | A1 | 2/2005 | Taguchi et al. | |

| | | | | |
|---|---|---|---|---|
| 2005/0068477 | A1 | 3/2005 | Shin et al. | |
| 2005/0083277 | A1 | 4/2005 | Credelle | |
| 2005/0083356 | A1 | 4/2005 | Roh et al. | |
| 2005/0099378 | A1* | 5/2005 | Kim | 345/99 |
| 2005/0099426 | A1 | 5/2005 | Primerano et al. | |
| 2005/0140634 | A1 | 6/2005 | Takatori | |
| 2005/0151752 | A1 | 7/2005 | Phan | |
| 2005/0162600 | A1 | 7/2005 | Rho et al. | |
| 2005/0219274 | A1 | 10/2005 | Yang et al. | |
| 2006/0208984 | A1* | 9/2006 | Kim et al. | 345/90 |
| 2007/0064190 | A1* | 3/2007 | Kim | 349/142 |
| 2007/0091044 | A1* | 4/2007 | Park et al. | 345/88 |

FOREIGN PATENT DOCUMENTS

| | | | |
|---|---|---|---|
| DE | 299 09 537 | U1 | 10/1999 |
| DE | 199 23 527 | | 11/2000 |
| DE | 201 09 354 | U1 | 9/2001 |
| EP | 0 158 366 | A2 | 10/1985 |
| EP | 0 203 005 | A1 | 11/1986 |
| EP | 0 322 106 | A2 | 6/1989 |
| EP | 0 671 650 | A2 | 9/1995 |
| EP | 0 878 969 | A3 | 11/1998 |
| EP | 0 899 604 | A2 | 3/1999 |
| EP | 1 381 020 | A2 | 1/2004 |
| GB | 2 133 912 | A | 8/1984 |
| GB | 2 146 478 | A | 4/1985 |
| JP | 60-107022 | | 6/1985 |
| JP | 02-000826 | A | 1/1990 |
| JP | 03-78390 | | 4/1991 |
| JP | 06-102503 | | 4/1994 |
| JP | 06-324649 | | 11/1994 |
| JP | 08-202317 | | 8/1996 |
| JP | 11-282008 | | 10/1999 |
| JP | 2004-004822 | | 1/2004 |
| JP | 2004 078218 | | 3/2004 |
| WO | WO 00/21067 | | 4/2000 |
| WO | WO 00/42762 | | 7/2000 |
| WO | WO 00/45365 | | 8/2000 |
| WO | WO 00/65432 | | 11/2000 |
| WO | WO 01/10112 | A2 | 2/2001 |
| WO | WO 02/101644 | A2 | 12/2002 |
| WO | WO 03/014819 | A1 | 2/2003 |
| WO | WO 03/050605 | A1 | 2/2003 |
| WO | WO 03/056383 | A1 | 7/2003 |
| WO | WO 2004/017129 | A1 | 2/2004 |
| WO | WO 2004/021323 | A2 | 3/2004 |
| WO | WO 2004/027503 | A1 | 4/2004 |
| WO | WO 2004/086128 | A1 | 10/2004 |
| WO | WO 2005/050296 | A1 | 6/2005 |

OTHER PUBLICATIONS

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the Pen Tile Matrix™ Color AMLCD Subpixel Architecture and Rendering Algorithms", SID 2003, Journal Article.

Brown Elliott, C, "New Pixel Layout for Pen Tile Matrix™ Architecture", IDMC 2002, pp. 115-117.

Brown Elliott, C, "Pentile Matrix™ Displays and Drivers" ADEAC Proceedings Paper, Portland OR., Oct. 2005.

Brown Elliott, C, "Reducing Pixel Count Without Reducing Image Quality", Information Display Dec. 1999, vol. 1, pp. 22-25.

Credelle, Thomas, "P-00: MTF of High-Resolution Pen Tile Matrix Displays", Eurodisplay 02 Digest, 2002 pp. 1-4.

Daly, Scott, "Analysis of Subtriad Addressing Algorithms by Visual System Models",SID Symp. Digest, Jun. 2001 pp. 1200-1203.

Klompenhouwer, Michiel, Subpixel Image Scaling for Color Matrix Displays, SID Symp. Digest, May 2002, pp. 176-179.

Krantz, John et al., Color Matrix Display Image Quality: The Effects of Luminance . . . SID 90 Digest, pp. 29-32.

Lee, Baek-woon et al., 40.5L: Late-News Paper: TFT-LCD with RGBW Color system, SID 03 Digest, 2003, pp. 1212-1215.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

Okumura et al., "A New Flicker-Reduction Drive Method for High Resolution LCTVs", SID Digest,pp. 551-554, 2001.

USPTO, Non-Final Office Action dated Oct. 26, 2005 in US Patent Publication No. 2004/0246213 (U.S. Appl. No. 10/455,925).

USPTO, Non-Final Office Action dated Oct. 19, 2004 in US Patent Publication No. 2004/0246381 (U.S. Appl. No. 10/455,931).

Clairvoyante Inc, Response to Non-Final Office Action dated Jan. 18, 2005 in US Patent Publication No. 2004/0246381 (U.S. Appl. No. 10/455,931).

USPTO, Final Office Action dated Jul. 12, 2005 in US Patent Publication No. 2004/0246381 (U.S. Appl. No. 10/455,931).

Clairvoyante Inc, Response to Final Office Action dated Jan. 12, 2006 in US Patent Publication No. 2004/0246381 (U.S. Appl. No. 10/455,931).

USPTO, Non-Final Office Action dated Jan. 23, 2006 in US Patent Publication No. 2004/0246278 (U.S. Appl. No. 10/455,927).

USPTO, Non-Final Office Action dated Sep. 2, 2004 in US Patent Publication No. 2004/0246404 (U.S. Appl. No. 10/456,838).

Clairvoyante Inc, Response to Non-Final Office Action dated Jan. 28, 2005 in US Patent Publication No. 2004/0246404 (U.S. Appl. No. 10/456,838).

USPTO, Final Office Action dated Jun. 9, 2005 in US Patent Publication No. 2004/0246404 (U.S. Appl. No. 10/456,838).

Clairvoyante Inc, Response to Final Office Action dated Dec. 5, 2005 in US Patent Publication No. 2004/0246404 (U.S. Appl. No. 10/456,838).

USPTO, Non-Final Office Action dated Jul. 26, 2004 in US Patent Publication No. 2004/0246393 (U.S. Appl. No. 10/456,794).

Clairvoyante Inc, Response to Non-Final Office Action dated Nov. 8, 2004 in US Patent Publication No. 2004/0246393 (U.S. Appl. No. 10/456,794).

USPTO, Non-Final Office Action dated May 4, 2005 in US Patent Publication No. 2004/0246393 (U.S. Appl. No. 10/456,794).

Clairvoyante Inc, Response to Non-Final Office Action dated Nov. 3, 2005 in US Patent Publication No. 2004/0246393 (U.S. Appl. No. 10/456,794).

PCT International Search Report dated Dec. 9, 2005 for PCT/US04/18034 (U.S. Appl. No. 10/455,925).

PCT International Search Report dated Feb. 1, 2006 for PCT/US04/18038 (U.S. Appl. No. 10/455,931).

PCT International Search Report dated Mar. 15, 2006 for PCT/US04/18033 (U.S. Appl. No. 10/455,927).

PCT International Search Report dated Jan. 10, 2006 for PCT/US04/18035 (U.S. Appl. No. 10/456,806).

PCT International Search Report dated Sep. 24, 2004 for PCT/US04/17796 (U.S. Appl. No. 10/456,838).

PCT International Search Report dated Nov. 3, 2004 for PCT/US04/18036 (U.S. Appl. No. 10/696,236).

PCT International Search Report dated Feb. 24, 2005 for PCT/US04/18037 (U.S. Appl. No. 10/456,794).

Clairvoyante, Inc, Response to Non-Final Office Action dated Apr. 26, 2006 in US Patent Publication No. 2004/0246213 (U.S. Appl. No. 10/455,925).

USPTO, Final Office Action dated Jun. 14, 2006 in US Patent Publication No. 2004/0246213 (U.S. Appl. No. 10/455,925).

Clairvoyante, Inc, Repsonse to Non-Final Office Action dated Nov. 10, 2006 in US Patent Publication No. 2004/0246213 (U.S. Appl. No. 10/455,925).

USPTO, Final Office Action dated Feb. 14, 2007 in US Patent Publication No. 2004/0246213 (U.S. Appl. No. 10/455,925).

USPTO, Non-Final Office Action dated May 1, 2006 in US Patent Publication No. 2004/0246381 (U.S. Appl. No. 10/455,931).

Clairvoyante Inc, Response to Non-Final Office Action dated Oct. 2, 2006 in US Patent Publication No. 2004/0246381 (U.S. Appl. No. 10/455,931).

Clairvoyante Inc, Response to Non-Final Office Action dated May 19, 2006 in US Patent Publication No. 2004/0246278 (U.S. Appl. No. 10/455,927).
USPTO, Final Office Action dated Aug. 9, 2006 in US Patent Publication No. 2004/0246278 (U.S. Appl. No. 10/455,927).
Clairvoyante Inc, Response to Non-Final Office Action dated Nov. 20, 2006 in US Patent Publication No. 2004/0246278 (U.S. Appl. No. 10/455,927).
USPTO, Non-Final Office Action dated Oct. 19, 2005 in US Patent Publication No. 7,187,353 (U.S. Appl. No. 10/456,806).
Clairvoyante Inc, Response to Non-Final Office Action dated Feb. 21, 2005 in US Patent Publication No. 7,187,353 (U.S. Appl. No. 10/456,806).
USPTO, Final Office Action dated May 2, 2006 in US Patent Publication No. 7,187,353 (U.S. Appl. No. 10/456,806).
Clairvoyante Inc, Response to Final Office Action dated Aug. 2, 2006 in US Patent Publication No. 7,187,353 (U.S. Appl. No. 10/456,806).
USPTO, Notice of Allowance, dated Sep. 18, 2006 in US Patent Publication No. 7,187,353 (U.S. Appl. No. 10/456,806).
USPTO, Non-Final Office Action dated Mar. 20, 2006 in US Patent Publication No. 2004/0246404 (U.S. Appl. No. 10/456,838).
Clairvoyante Inc, Response to Non-Final Office Action dated Sep. 14, 2006 in US Patent Publication No. 2004/0246404 (U.S. Appl. No. 10/456,838).
USPTO, Final Office Action dated Jan. 18, 2007 in US Patent Publication No. 2004/0246404 (U.S. Appl. No. 10/456,838).
Clairvoyante Inc, Response to Final Office Action dated Jun. 18, 2007 in US Patent Publication No. 2004/0246404 (U.S. Appl. No. 10/456,838).
USPTO, Final Office Action dated Jan. 18, 2007 in US Patent Publication No. 2004/0246393 (U.S. Appl. No. 10/456,794).

* cited by examiner

DOT INVERSION ON NOVEL DISPLAY PANEL LAYOUTS WITH EXTRA DRIVERS

RELATED APPLICATIONS

This application is a continuation of, and claims priority to, U.S. patent application Ser. No. 10/456,806 filed on Jun. 6, 2003, now issued as U.S. Pat. No. 7,187,353 B2 U.S. Pat. No. 10/456,806 was published as U.S. Patent Application Publication No. 2004/0246279 which is hereby incorporated by reference herein for all that it teaches.

The present application is related to commonly owned United States Patent Applications: (1) U.S. patent application Ser. No. 10/455,925 entitled "DISPLAY PANEL HAVING CROSSOVER CONNECTIONS EFFECTING DOT INVERSION" and published as U.S. Patent Publication No. 2004/0246213 ("the '213 application"); (2) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS " and published as U.S. Patent Publication No. 2004/0246381 ("the '381 application"), now issued as U.S. Pat. No. 7,218,301 B2; (3) U.S. patent application Ser. No. 10/455,927 entitled "SYSTEM AND METHOD FOR COMPENSATING FOR VISUAL EFFECTS UPON PANELS HAVING FIXED PATTERN NOISE WITH REDUCED QUANTIZATION ERROR" and published as U.S. Patent Publication No 2004/0246278 ("the '278 application "), now issued as U.S. Pat. No. 7,209,105 B2; (4) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS" and published as U.S. Patent Publication No. 2004/0246404 ("the '404 application") and (5) U.S. patent application Ser. No. 10/456,839 entitled "IMAGE DEGRADATION CORRECTION IN NOVEL LIQUID CRYSTAL DISPLAYS," and published as U.S. Patent Publication No. 2004/0246280 ("the '280 application") which are hereby incorporated herein by reference.

BACKGROUND

In commonly owned United States Patent Applications: (1) U.S. patent application Ser. No. 09/916,312 entitled "ARRANGEMENT OF COLOR PIXELS FOR FULL COLOR IMAGING DEVICES WITH SIMPLIFIED ADDRESSING," filed Jul. 25, 2001 and issued as U.S. Pat. No. 6,903,754 ("the '754 patent"); (2 ) U.S. patent application Ser. No. 10/278,353 entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002 and published as U.S. Patent Publication No. 2003/0128225 ("the '225 application"); (3) U.S. patent application Ser. No. 10/278,352 entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002 and published as U.S. Patent Publication No. 2003/0128179 ("the '179 application"); (4) U.S. patent application Ser. No. 10/243,094 entitled "IMPROVED FOUR COLOR ARRANGEMENTS AND EMITTERS FOR SUB-PIXEL RENDERING," filed Sep. 13, 2002 and published as U.S. Patent Publication No. 2004/0051724 ("the '724 application"), now abandoned in favor continuation application U.S. Pat. No. 11/469.458; (5) U.S. patent application Ser. No. 10/278,328 entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002 and published as U.S. Patent Publication No. 2003/0117423 ("the '423 application"), now abandoned in favor of divisional application U.S. Pat. No. 11/734,053; (6) U.S. patent application Ser. No. 10/278,393 entitled "COLOR DISPLAY HAVING HORIZONTAL SUB-PIXEL ARRANGEMENTS AND LAYOUTS," filed Oct. 22, 2002 and published as U.S. Patent Publication No. 2003/0090581 ("the '581 application"); (7) U.S. patent application Ser. No. 10/347,001 entitled "IMPROVED SUB-PIXEL ARRANGEMENTS FOR STRIPED DISPLAYS AND METHODS AND SYSTEMS FOR SUB-PIXEL RENDERING SAME, "filed Jan. 16, 2003, and published as Patent Publication No. 2004/0080479 ("the '479 application"), now abandoned, novel sub-pixel arrangements are therein disclosed for improving the cost/performance curves for image display devices and these applications are herein incorporated by reference.

These improvements are particularly pronounced when coupled with sub-pixel rendering (SPR) systems and methods further disclosed in those applications and in commonly owned U S Patent Applications: (1) U.S. patent application Ser. No. 10/051,612 entitled "CONVERSION OF A SUB-PIXEL FORMAT DATA TO ANOTHER SUB-PIXEL DATA FORMAT," filed Jan. 16, 2002 and published as U.S. Patent Publication No. 2003/0034992 ("the '992 application") and now issued as U.S. Pat. No. 7,123,277; (2) U.S. patent application Ser. No. 10/150,355 entitled "METHODS AND SYSTEMS FOR SUB-PIXEL RENDERING WITH GAMMA ADJUSTMENT," filed May 17, 2002 and published as U.S. Patent Publication No. 2003/0103058 ("the '058 application") and now issued as U.S. Pat. No. 7,221,381; (3) U.S. patent application Ser. No. 10/215,843 entitled "METHODS AND SYSTEMS FOR SUB-PIXEL RENDERING WITH ADAPTIVE FILTERING, " filed Aug. 8, 2002 and published as U.S. Patent Publication No. 2003/0085906 ("the '906 application") and now issued as U.S. Pat. No. 7,184,066;(4) U.S. patent application Ser. No. 10/379,767 entitled "SYSTEMS AND METHODS FOR TEMPORAL SUB-PIXEL RENDERING OF IMAGE DATA " filed Mar. 4, 2003 and published as U.S. Patent Publication No. 2004/0196302 ("the '302 application"), now abandoned in favor of continuation application U.S. Pat. No. 11/462.979; (5) U.S. patent application Ser. No. 10/379,765 entitled "SYSTEMS AND METHODS FOR MOTION ADAPTIVE FILTERING,"filed Mar. 4, 2003 and issued as U.S. Pat. No. 7,167,186 ("the '186 patent"); (6) U.S. patent application Ser. No. 10/379,766 entitled "SUB-PIXEL RENDERING SYSTEM AND METHOD FOR IMPROVED DISPLAY VIEWING ANGLES" filed Mar. 4, 2003 and issued as U.S. Pat. No. 6,917,368 ("the '368 Patent ") (7) U.S. patent application Ser. No. 10/409,413 entitled "IMAGE DATA SET WITH EMBEDDED PRE-SUBPIXEL RENDERED IMAGE" filed Apr. 7, 2003, and published as Patent Publication No. 2004/0196297 ("the '297 application") which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
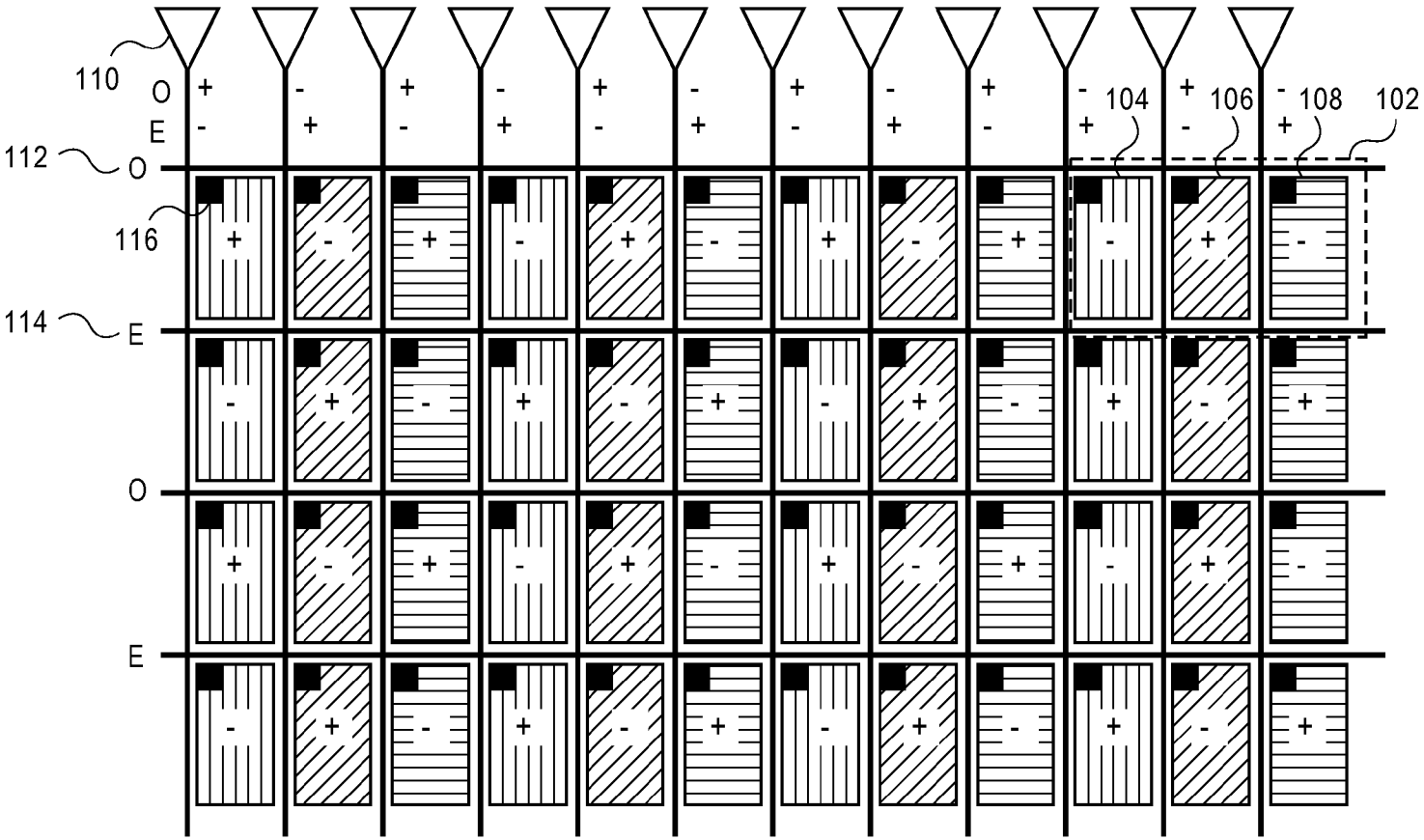
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk and flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("0") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
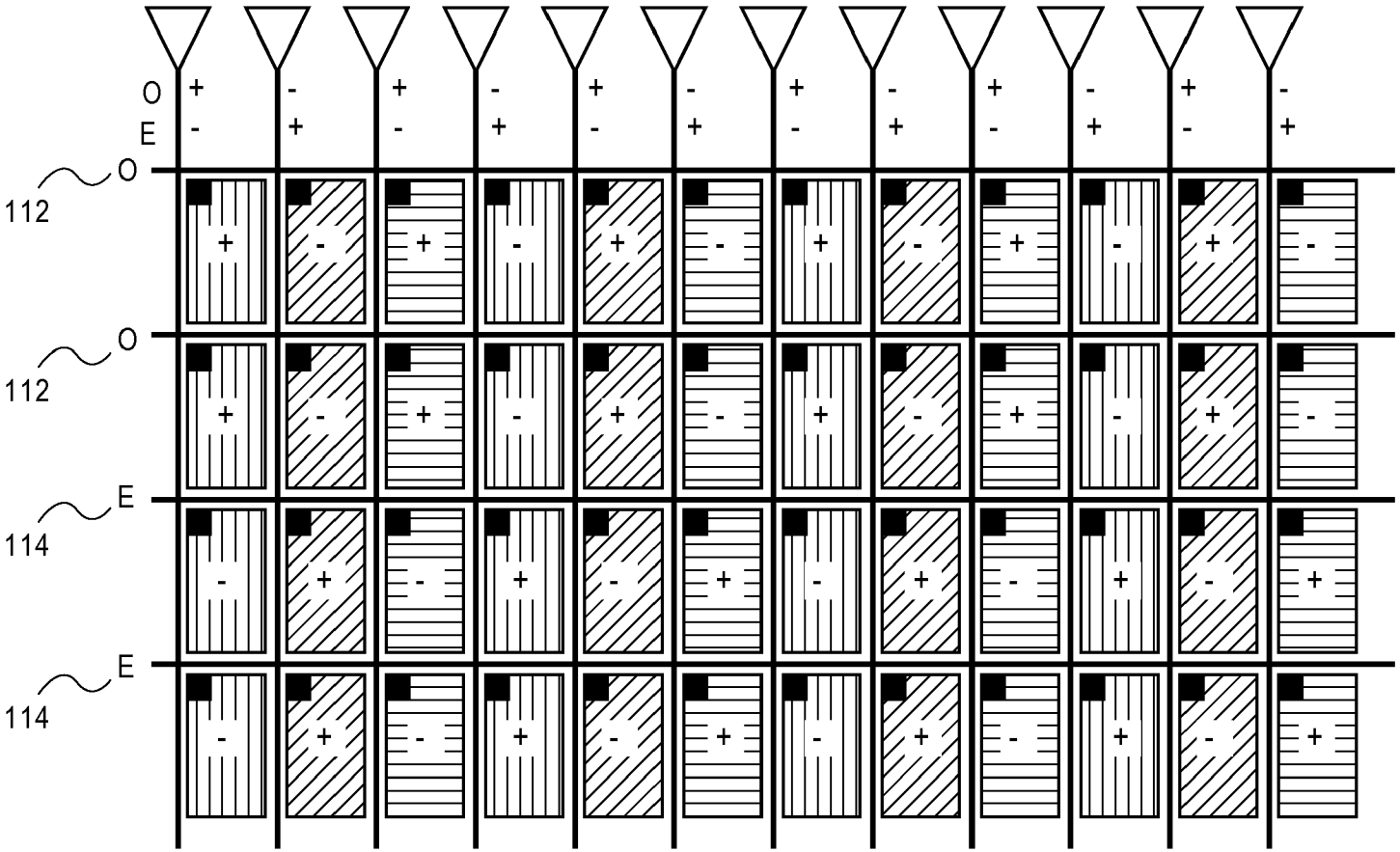
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column with have opposite polarity; whereas in 1×2 dot inversion, each group of two successive red subpixels will have opposite polarity. This changing of polarity decreases noticeable visual effects that occur with particular images rendered upon an AMLCD panel.

Figure 2:
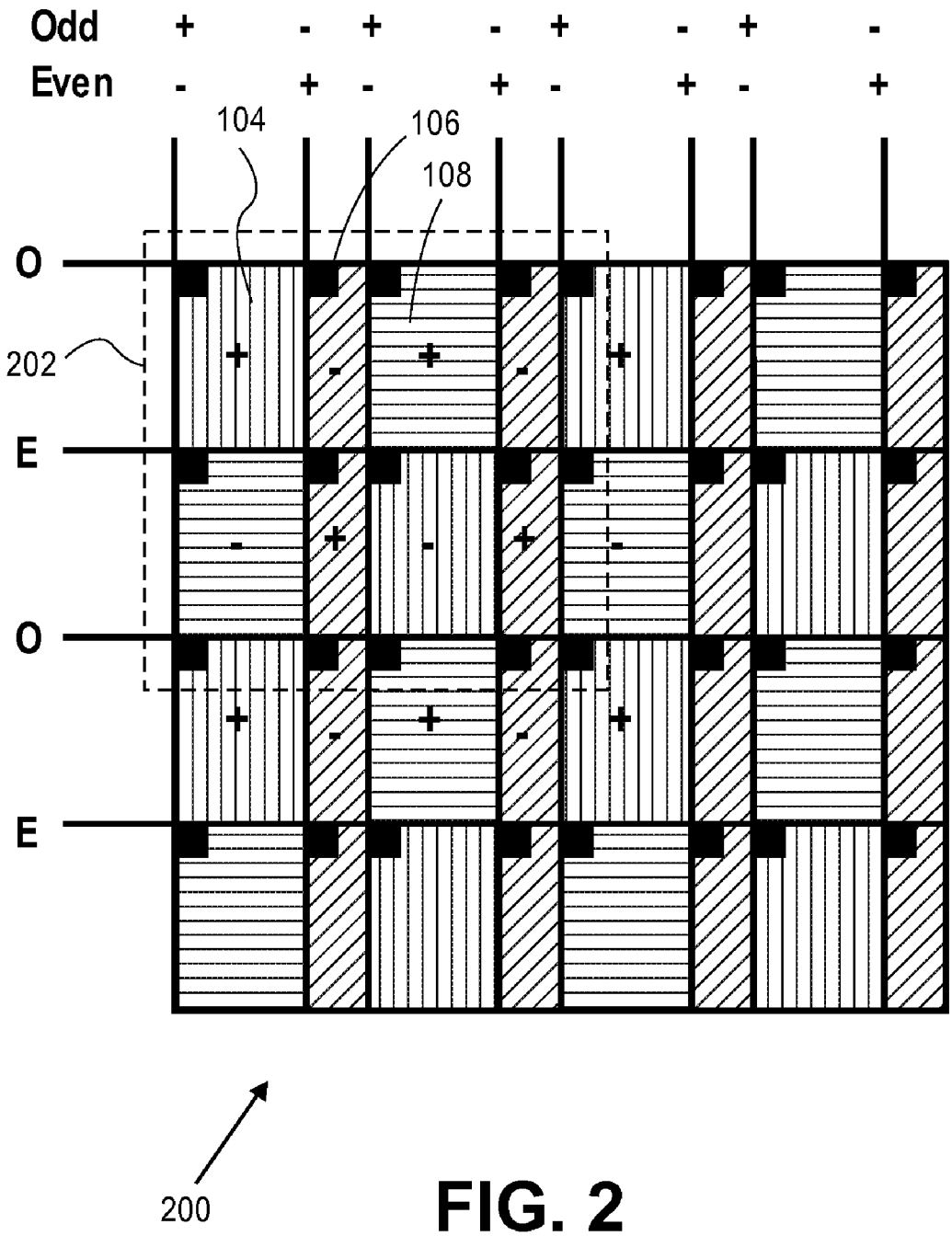
FIG. 2 depicts a novel panel display comprising a subpixel repeat grouping that is of even modulo.

FIG. 2 shows a panel comprising a repeat subpixel grouping 202, as further described in the '225 application. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeat grouping—for example, the subpixel repeat grouping in FIG. 1 of the '179 application—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number) of subpixels in its repeat group across a row (e.g. R, G, B, and G). It will be appreciated that the embodiments described herein are equally applicable to all such even modulus repeat groupings.

Figure 3:
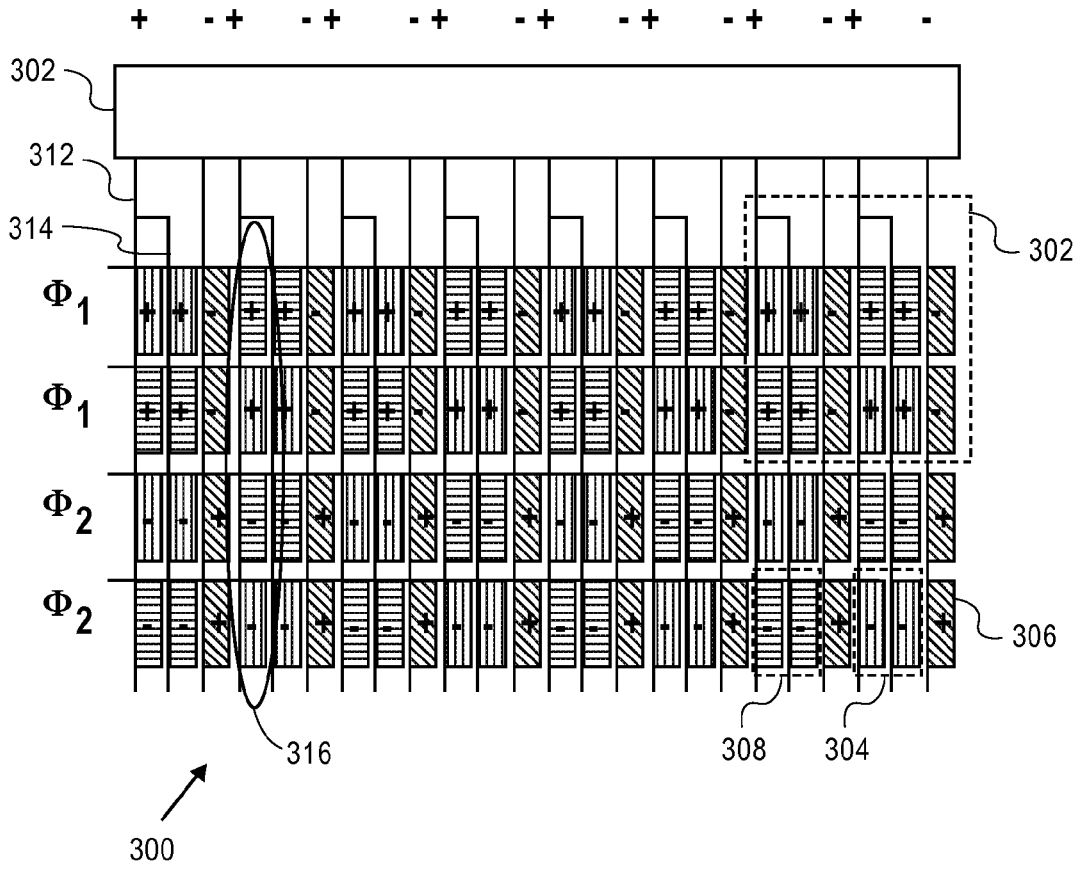
FIG. 3 shows one embodiment of a display panel having a novel subpixel repeating group structure of six subpixels along a row by two columns having a set of regularly occurring interconnects to enable sharing of image data for at least two columns.

FIG. 3 is a panel having a novel subpixel repeating group that is a variation of the subpixel repeating group found in FIG. 2. The repeating group 302 is comprised of double red subpixels 304 and double blue subpixels 308 (where each such red and blue subpixel could be sized, for one embodiment, approximately the same size as a standard RGB striped subpixel), and a reduced green subpixel 306 (which also could be sized, for one embodiment, approximately the same size as regular RGB striped subpixel). Each double red and double blue subpixels would ostensibly act as one larger red or blue subpixel, respectively (such as shown in FIG. 2)—thus, one embodiment would have interconnects 314 coming from red and blue column lines 312 so that the image data would be shared by the double red and blue subpixels. One possible advantage of using regularly sized RGB striped subpixels as one embodiment is that existing TFT backplanes may be employed—thereby reducing some manufacture redesign costs. Another possible advantage is that—with the interconnects—a reduced number of drivers is needed to drive the entire panel.

FIG. 3 also shows one possible dot inversion scheme (e.g. 1×2) implemented on the panel by driver chip 302. As discussed above, the fact that same colored subpixels across a row have the same polarity may induce undesirable visual effects. Additionally, the fact that adjacent columns (as depicted in oval 316) have the same polarities may also create undesirable visual effects.

Figure 4:
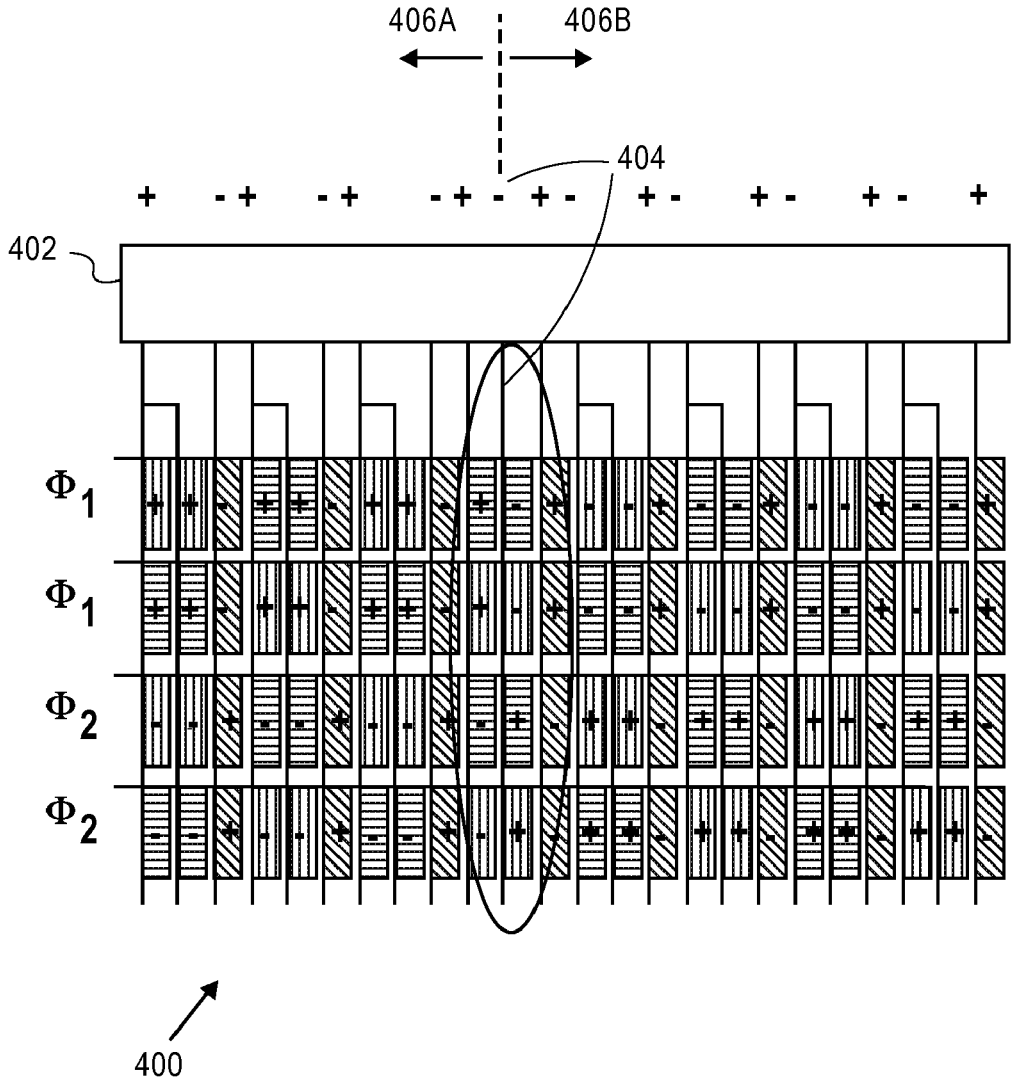
FIG. 4 shows the display panel of FIG. 3 wherein at least one regularly occurring interconnect in FIG. 3 is replaced with a new drive (column) line to effect different regions of polarity for same colored subpixels.

FIG. 4 shows one possible embodiment of a system that can remove or abate the visual defects above. In this case, an extra driver 404 (which could be assigned from some of the column drivers saved by virtue of use of interconnects) is assigned to one of the double red and blue subpixel columns. By occasionally assigning an extra driver to such a column across the panel, it can be seen that the same colored subpixels on either side of the extra driver (e.g. 406*a* and 406*b*) switch polarity—which will have the tendency to abate the visual effects induced as described above. How often to assign such drivers across a given panel design can be determined heuristically or empirically—clearly, there should be enough extra drivers to abate the visual effect; but any more than that may not be needed. It will be appreciated that although a 1×2 dot inversion scheme is shown, other inversion schemes will also benefit from the techniques described herein.

Figure 5:
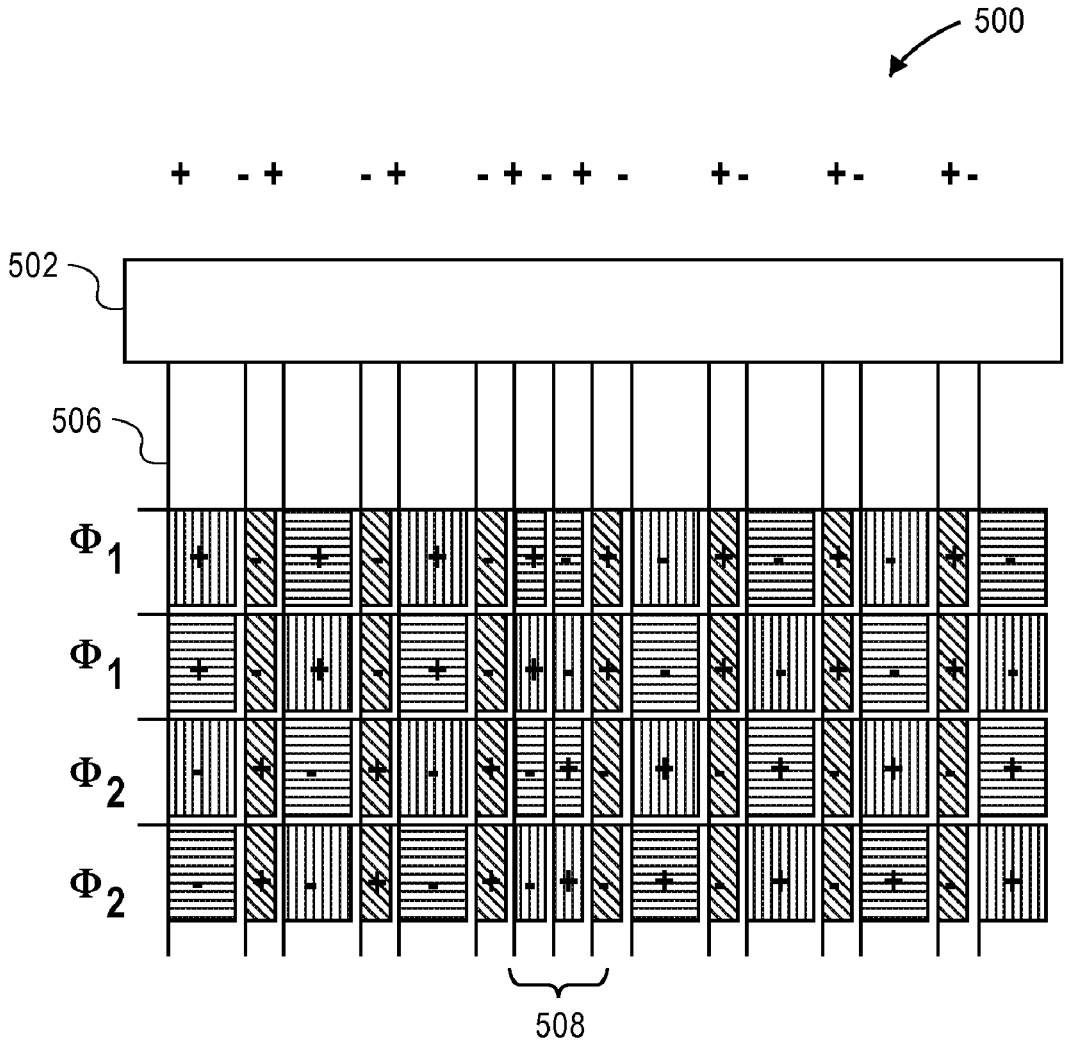
FIG. 5 shows another embodiment of a display panel having a subpixel repeating group structure of two column of larger subpixels and two columns of smaller subpixels wherein at least one such column of larger subpixels is split to effect different regions of polarity for same colored subpixels.

FIG. 5 is yet another embodiment of a panel 500 having a novel subpixel repeating group. Panel 500 comprises substantially the same repeat grouping shown in FIG. 2—but, occasionally, one of the red and blue subpixel columns is split (as shown in 508) and an extra driver from the driver chip 502 is assigned to the split column. The effect of this split column is similar to the effect as produced in FIG. 4 above. An advantage of this embodiment is that the capacitance due to the column line that serves as the load to the driver is substantially reduced, thereby reducing the power required to drive the column. With the combined use of full size and smaller sized subpixels though, there might be an unintended consequence of off-axis viewing angle differences. Such viewing angle differences might be compensated for, as described in several co-pending applications that are incorporated above and in the following paragraphs.

Figure 7A:
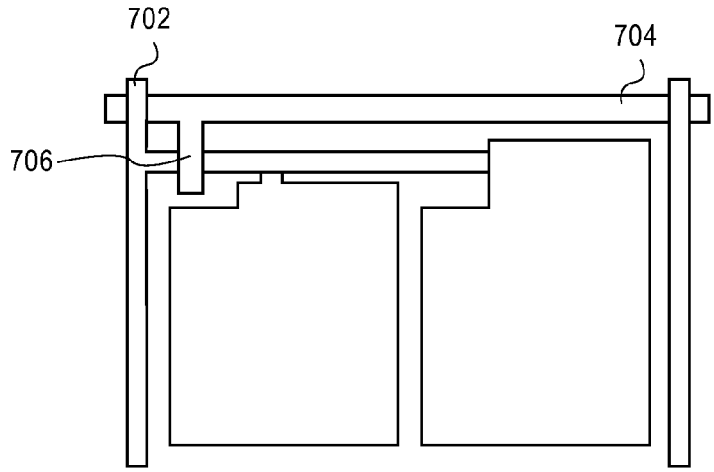
FIGS. 7A, 7B, and 7C show embodiments of illuminating areas for a display panel with thin-film transistors (TFTs).
Figure 7B:
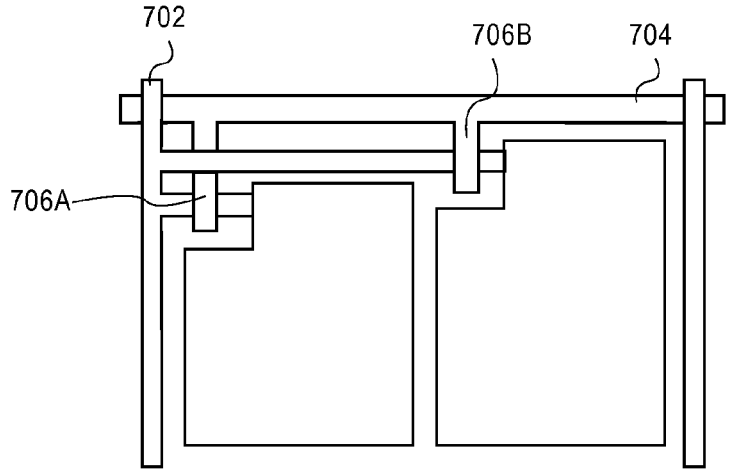
Figure 7C:
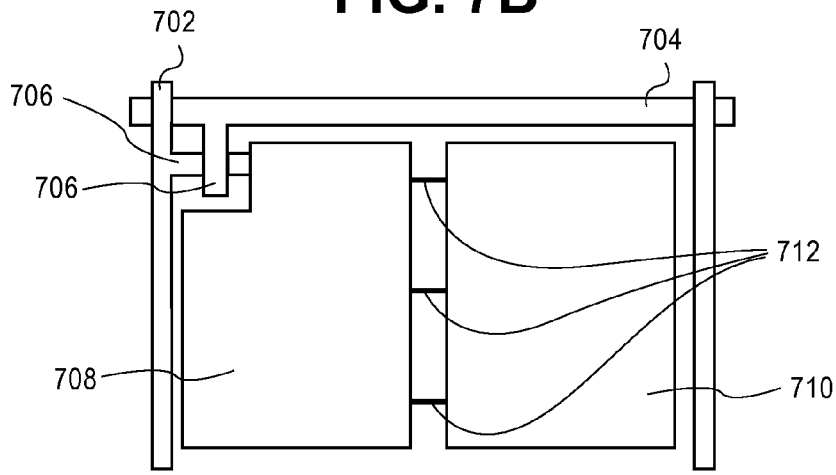

Another embodiment that may address viewing angles is a technique whereby the viewing angle characteristics of the larger pixel are designed to match those of the smaller pixel. In FIGS. 7A, 7B and 7C, this is accomplished by creating one large pixel, comprised of two small illuminating areas, each of which has the same viewing angle characteristics of the small size pixel. In FIG. 7A, each illuminating area is driven by TFT 706. TFT 706 is connected to the column line 702 and the gate line 704. In the embodiment described in FIG. 7B, the output of TFT 706A drives a first illuminating area, and TFT 706B drives a second illuminating area. In FIG. 7C, the electrode 708 is connected directly to the electrode 710 via a plurality of interconnects 712 in one or more locations. This embodiment allows greater aperture ratio.

The embodiment of FIGS. 7A, 7B, and 7C are shown for a standard TFT layout. It should appreciated that the electrode patterns for some viewing angle technologies—such as In Plane Switching—are different. These concepts will still apply to all viewing angle technologies.

Figure 6:
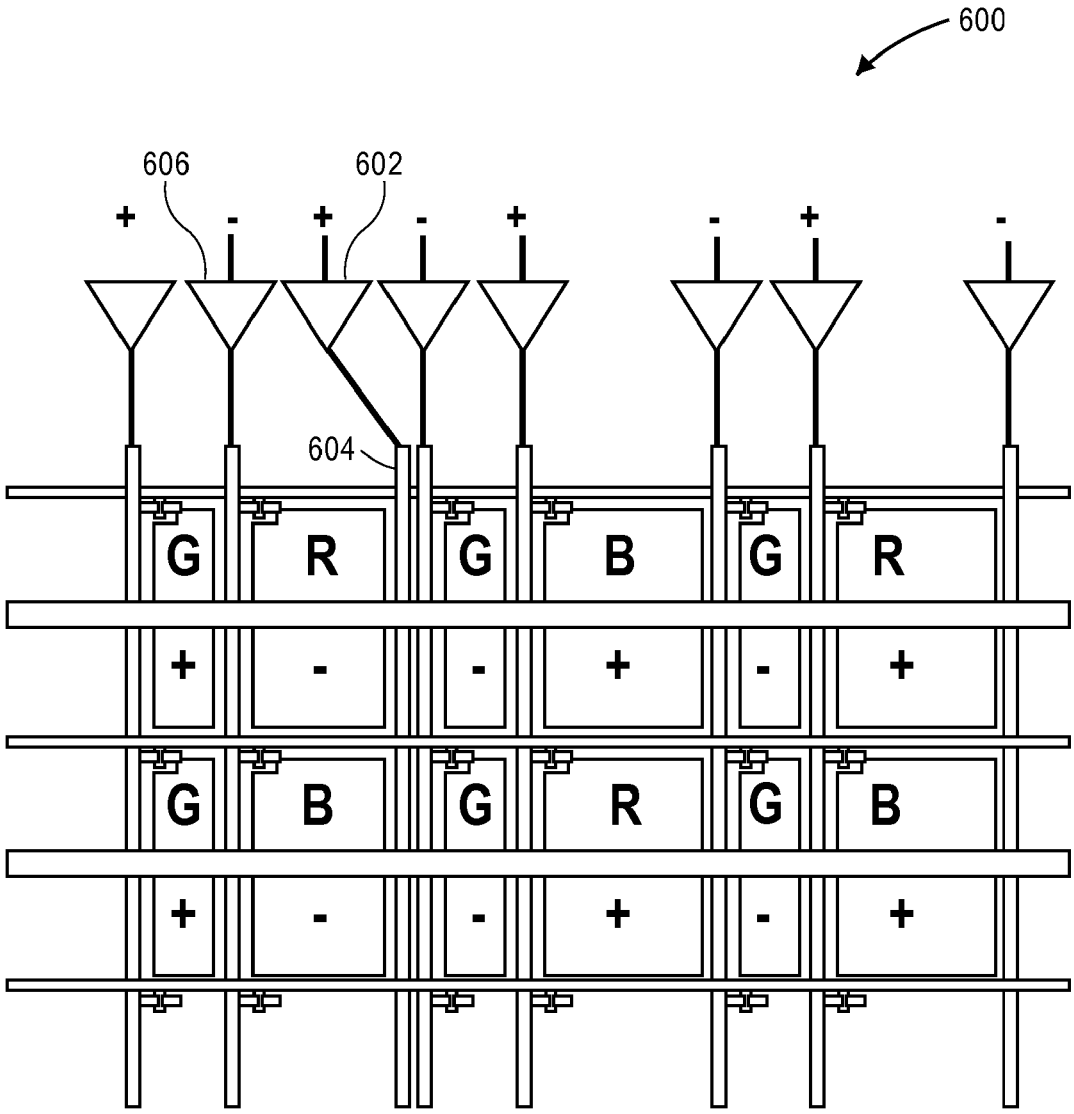
FIG. 6 shows another embodiment of a display panel having a subpixel repeating group structure of even modulo wherein an extra driver is employed with a column line running down the panel to shield against undesirable visual effects from occurring on the panel.

Yet another embodiment using additional drivers is depicted in FIG. 6. Panel 600 may comprise the subpixel repeating group as shown in FIG. 2—or any other suitable even-modulo grouping. It is appreciated that this technique could be applied with or without double or split subpixels. Extra driver 602 is connected to a column line 602—which could be a "dummy "line—i.e. not connected to any TFT or the like. When column line 602 is driven with opposite polarity to that of adjacent column line 606, column line 602 provides an effective shield against the polarity problems and their associated visual effects that are described above. Additional shielding may be provided by having the data on line 602 be the inverse of the data provided on line 606. Since there may be some impact on aperture ratio as a result of adding the extra column line, it may be desirable to compensate for this impact. It may be appreciated that the embodiment illustrated in FIG. 6 can be applied in combination with other techniques described herein and that all of the techniques herein may be applied in combination with other techniques in the related and co-pending cases noted above.

As it is known upon manufacture of the panel itself, it is possible to compensate for any undesirable visual effect using different techniques. As described in copending and commonly assigned U.S. Patent Publication No. 2004/0246278 ("the '278 application "), entitled "SYSTEM AND METHOD FOR COMPENSATING FOR VISUAL EFFECTS UPON PANELS HAVING FIXED PATTERN NOISE WITH REDUCED QUANTIZATION ERROR" and incorporated herein by reference, there are techniques that may be employed to reduce or possibly eliminate for these visual effects. For example, a noise pattern may be introduced to the potential effected columns such that known or estimated darkness or brightness produce by such columns are adjusted. For example, if the column in question is slightly darker than those surrounding columns than the darker column may be adjusted to be slightly more ON than its neighbors.

What is claimed is:

1. A display system comprising:

a display panel substantially comprising a plurality of first and second subpixel repeating groups; each said first subpixel repeating group comprising an even number of colored subpixels in a gate signal direction; each said second subpixel repeating group comprising at least one pair of first and second adjacent columns wherein the first and second adjacent columns have same colored subpixels and there is no intervening column between the first and second adjacent columns; and a plurality of data drivers configured for supplying image data and polarity signals to the subpixels on said display panel; wherein said first column of same-colored subpixels in said second subpixel repeating group is driven by a first data driver and said second adjacent column of same-colored subpixels is driven by a second data driver such that said first and second data drivers transmit common image data signals to said first and second adjacent columns of same-colored subpixels and said first and second data drivers transmit different polarity signals to said first and second adjacent columns of same-colored subpixels.

2. The display system of claim 1 wherein said at least one pair of first and second adjacent columns in each of said second subpixel repeating groups is formed by splitting one subpixel in at least one of said first subpixel repeating groups on said display panel into two separate subpixels.

3. The display system of claim 2 wherein said at least one pair of first and second adjacent columns in said second subpixel repeating group are formed by splitting into two separate subpixels at least one blue colored subpixel in at least one of said first subpixel repeating groups on said display panel.

4. The display system of claim 2 wherein said at least one pair of first and second adjacent columns are formed by splitting into two separate subpixels at least one red colored subpixel in at least one of said first subpixel repeating groups on said display panel.

5. The display system of claim 1 wherein said display panel substantially comprises more first subpixel repeating groups tiled across said display than second subpixel repeating groups; said second subpixel repeating groups comprising said at least one pair of first and second adjacent columns of same-colored subpixels being vertically tiled in locations on said display panel so as to change polarity signals applied to subpixels in some of said first subpixel repeating groups when a conventional polarity scheme is applied to said display panel.

* * * * *